US011585569B2

(12) United States Patent
Chun et al.

(10) Patent No.: US 11,585,569 B2
(45) Date of Patent: Feb. 21, 2023

(54) AIR CONDITIONER

(71) Applicant: SAMSUNG ELECTRONICS CO., LTD., Suwon-si (KR)

(72) Inventors: Sunghyun Chun, Suwon-si (KR); Junseok Kwon, Suwon-si (KR); Daedong Kim, Suwon-si (KR); Moonsun Shin, Suwon-si (KR); Wonhee Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 233 days.

(21) Appl. No.: 16/950,072

(22) Filed: Nov. 17, 2020

(65) Prior Publication Data

US 2021/0156590 A1 May 27, 2021

(30) Foreign Application Priority Data

Nov. 22, 2019 (KR) ..... 10-2019-0151076

(51) Int. Cl.

| | |
|---|---|
| ***F24F 13/24*** | (2006.01) |
| ***F04D 29/66*** | (2006.01) |
| *F24F 130/40* | (2018.01) |

(52) U.S. Cl.

CPC ..... *F24F 13/24* (2013.01); *F04D 29/668* (2013.01); *F24F 2130/40* (2018.01)

(58) Field of Classification Search

CPC ..... F24F 13/24; F24F 13/1426; F24F 13/14; F24F 13/1486; F24F 13/06; F04D 29/668

See application file for complete search history.

(56) References Cited

FOREIGN PATENT DOCUMENTS

| | | | |
|---|---|---|---|
| CN | 104456892 | | 3/2015 |
| JP | 6-179317 | | 6/1994 |
| JP | 8-75236 | | 3/1996 |
| JP | 2003083565 A | * | 3/2003 |
| JP | 3885845 | | 2/2007 |
| JP | 2008-190809 | | 8/2008 |
| JP | 2009210207 A | * | 9/2009 |
| JP | 2010014299 | | 1/2010 |
| JP | 2016-99081 | | 5/2016 |

(Continued)

OTHER PUBLICATIONS

International Search Report dated Mar. 5 from International Application No. PCT/KR2020/016139, 3 pages.

(Continued)

*Primary Examiner* — Emmanuel E Duke
(74) *Attorney, Agent, or Firm* — Staas & Halsey LLP

(57) ABSTRACT

An air conditioner includes a housing including an inlet and an outlet, and a blade rotatably provided to open and close the outlet. A blade drive device is connected to one end of the blade in a longitudinal direction of the blade to rotate the blade. A blade support unit is configured to rotatably support the other end of the blade in the longitudinal direction of the blade. The blade support unit includes a coil spring configured to apply torque to the blade and a blade holder is coupled to the other end of the blade. A first coupler is coupled to the coil spring, and is configured to penetrate the coil of the coil spring. A case is configured to accommodate the first coupler of the blade holder and is mounted to the housing. The air conditioner is capable of reducing deformation and noise in a blade.

20 Claims, 17 Drawing Sheets

(56) References Cited

FOREIGN PATENT DOCUMENTS

| | | | | |
|---|---|---|---|---|
| JP | 6359958 | | 7/2018 | |
| KR | 1998-016414 | | 6/1998 | |
| KR | 10-0199987 | | 5/1999 | |
| WO | WO-2017057229 | A1 * | 4/2017 | ..... F24F 13/14 |

OTHER PUBLICATIONS

Extended European Search Report dated Sep. 26, 2022 for European Application No. 20888986.5.

* cited by examiner

AIR CONDITIONER

CROSS-REFERENCE TO RELATED APPLICATION(S)

This application is based on and claims priority under 35 U.S.C. § 119 to Korean Patent Application No. 10-2019-0151076, filed on Nov. 22, 2019, in the Korean Intellectual Property Office, the disclosure of which is incorporated by reference herein in its entirety.

BACKGROUND

1. Field

The disclosure relates to an air conditioner, and more particularly, to an air conditioner capable of reducing deformation and noise in a blade.

2. Description of Related Art

In general, an air conditioner is a device that adjusts temperature, humidity, flow, distribution, etc. of air to be suitable for human activities by using the refrigeration cycle. A compressor, a condenser, an evaporator, and a blower fan are provided as main components of the refrigeration cycle.

The air conditioner may be classified into a split type-air conditioner in which an indoor unit and an outdoor unit are installed separately, and an integrated type-air conditioner in which an indoor unit and an outdoor unit are installed together in a single cabinet. The indoor unit of the split type-air conditioner includes a heat exchanger configured to perform heat exchange with air sucked into an inside of a panel, and a blower fan configured to suck air from a room into the inside of the panel and blow the sucked air back into the room.

Air, which is introduced into the indoor unit, is discharged to the outside of the indoor unit through the outlet by the blower fan, and the air conditioner includes a blade configured to control a discharge direction of the discharged air.

Usually, the blade is rotated by one drive device provided on a rotating shaft, thereby changing the direction of the air. In this case, vibration and noise may occur at one end of the rotating shaft in which the drive device is not provided, and bending caused by the blade's own weight or fatigue deformation caused by repeated rotation of the blade may occur.

SUMMARY

Therefore, it is an aspect of the disclosure to provide an air conditioner including a blade support unit to allow a blade to be rotated by a single drive device without noise and vibration.

It is another aspect of the disclosure to provide an air conditioner including a blade support unit to reduce bending in a blade caused by a blade's own weight or fatigue deformation caused by repeated rotation of the blade which occurs in the blade.

It is another aspect of the disclosure to provide an air conditioner capable of allowing a blade support unit, which is separately manufactured, to be easily mounted to the air conditioner.

Additional aspects of the disclosure will be set forth in part in the description which follows and, in part, will be clear from the description, or may be learned by practice of the disclosure.

In accordance with an aspect of the disclosure, an air conditioner includes a housing having an inlet and an outlet, a blade which is rotatable to open and close the outlet, a blade drive device coupled to one end of the blade in a longitudinal direction of the blade and configured to rotate the blade, and a blade support configured to rotatably support the other end of the blade in the longitudinal direction of the blade. The blade support includes a coil spring having a coil and configured to apply torque to the blade, a blade holder coupled to the other end of the blade, including a coupler configured to extend into the coil of the coil spring, and a case coupled to the housing and configured to accommodate the coupler.

The blade holder may be rotatably coupled to the case.

The coupler is a first coupler. The case includes a second coupler coupled to the coil spring.

The coil spring may be between the case and the blade holder.

The coil spring may include a first extended portion provided to extend from one side of the coil and a second extended portion provided to extend from the other side of the coil, and the first extended portion may be fixed to the first coupler and the second extended portion may be fixed to the second coupler.

The first coupler may be rotated based on a rotation of the blade holder, and the case may include a rail configured to guide a movement of the first coupler.

The case may include a stopper disposed at opposite ends of the rail and configured to limit a movement range of the first coupler.

The blade holder may transmit the torque, which is applied to the blade holder by the coil spring, to the blade, and the coil spring may apply the torque to the blade holder.

The coil spring may be configured to apply the torque in a direction opposite to a torque that is applied by the blade drive device to the blade to open the outlet.

The case may accommodate the blade holder and the coil spring, and the case may include a fixer configured to fix the case to the housing.

In accordance with another aspect of the disclosure, an air conditioner includes a housing having an inlet and an outlet, a blade which is rotatable to open and close the outlet, a blade drive device coupled to one end of the blade in a longitudinal direction of the blade and configured to rotate the blade, and a blade support configured to rotatably support the other end of the blade in the longitudinal direction of the blade. The blade support includes an elastic member configured to apply torque to the blade, a blade holder coupled to the other end of the blade so as to be rotated according to a rotation of the blade, the blade holder including a coupler configured to be coupled to one end of the elastic member, and a case rotatably coupled to the blade holder and configured to accommodate the coupler and the elastic member, the case being coupled to the housing. The case includes a stopper on a movement path of the coupler to limit a rotation range of the blade holder.

In accordance with another aspect of the disclosure, an air conditioner includes a housing having an opening configured to allow air to be discharged, a blade which is rotatable to open and close the opening of the housing, a blade drive device coupled to one end of the blade and configured to rotate the blade, and a blade support configured to rotatably support the other end of the blade. The blade support includes a blade holder coupled to the blade and configured to be rotated according to a rotation of the blade, an elastic member configured to apply torque to the blade holder, and a stopper on a movement path of the blade holder to limit a rotation range of the blade holder.

The elastic member may include a torsion spring member, and the elastic member may include a coil configured to provide an elastic force, a first extended portion extending from one side of the coil and a second extended portion extending from an other side of the coil.

The blade holder may include a rotation arm extending from a side surface of the blade holder and configured to be rotated with the blade holder, and a coupler provided on one end of the rotation arm, the coupler being coupled to one end of the elastic member, and the coil may be configured to surround the blade holder and the first extended portion may be coupled to the coupler.

The air conditioner may further include a case rotatably coupled to the blade holder and configured to cover the elastic member and the blade holder, a movement path of the blade holder being provided in the case, and the case may be fixed to the housing so as not to move.

The coupler is a first coupler. The case may include a second coupler configured to be coupled to an other end of the elastic member, and the second extended portion may be coupled to the second coupler.

The stopper may be in the case.

The second coupler to which the other end of the elastic member is coupled may be provided in the housing, and the second extended portion may be coupled to the second coupler.

The blade holder may include a stop protrusion configured to be rotated with the blade holder. The stopper may include a pair of stoppers, and may be integrally formed with the second coupler. One of the pair of stoppers may be provided on a movement path of the stop protrusion to stop a movement of the stop protrusion, and the other of the pair of stoppers may be provided on a movement path of the rotation arm to stop a movement of the rotation arm.

The housing may include a fastening groove configured to be coupled to the blade holder, and the blade holder may include a fastening plate rotatably provided on the blade holder and configured to penetrate the fastening groove. The blade holder may be configured to be inserted into the housing so that the fastening plate penetrates the fastening groove, and the blade holder may be coupled to the housing to prevent the fastening plate from being removed from the fastening groove due to a rotation of the fastening plate.

BRIEF DESCRIPTION OF THE DRAWINGS

These and/or other aspects of the disclosure will become apparent and more readily appreciated from the following description of embodiments, taken in conjunction with the accompanying drawings of which:

FIG. 7 is an exploded perspective view of the blade support unit shown in

FIG. 6;

DETAILED DESCRIPTION

Figure 1:
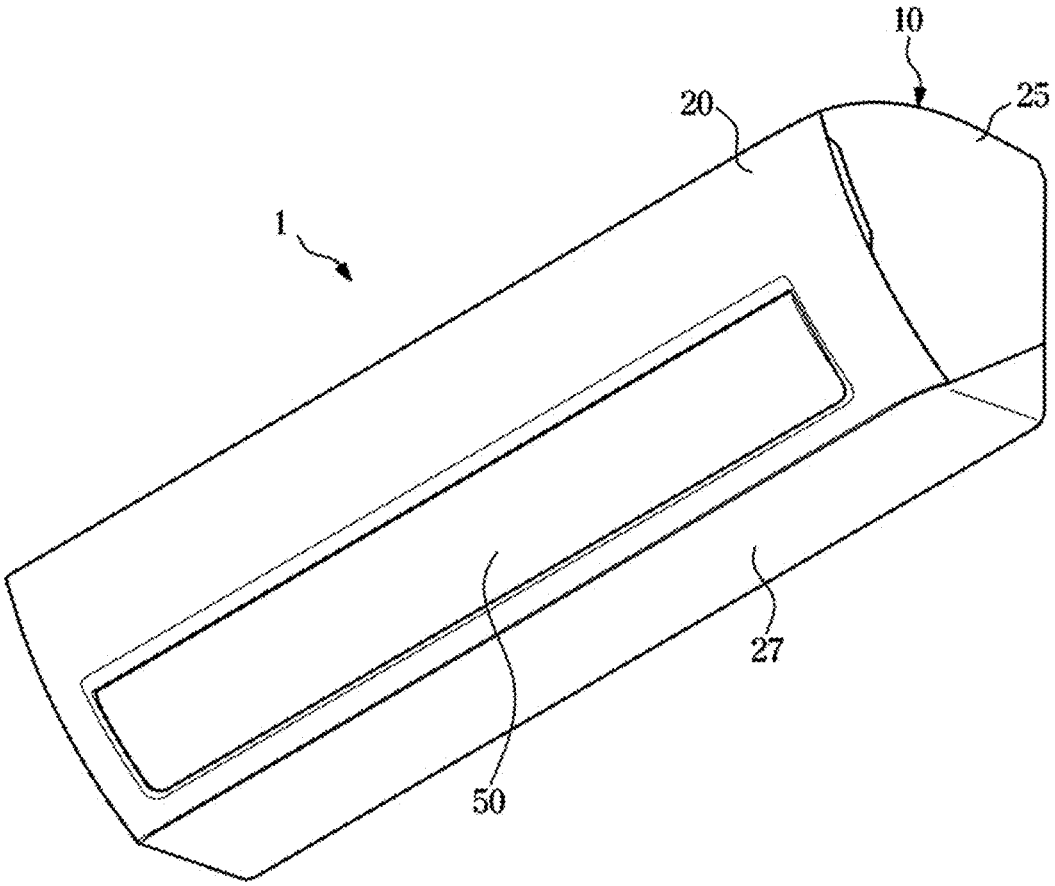
FIG. 1 is a perspective view of an air conditioner according to an embodiment of the disclosure.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

The terms "front", "rear", "upper", "lower" and the like used below are defined based on the drawings, and the shape and position of each component are not limited by this term.

Hereinafter, embodiments of the disclosure will be described in detail with reference to the accompanying drawings.

The refrigeration cycle constituting an air conditioner includes a compressor, a condenser, an expansion valve, and an evaporator. The refrigeration cycle performs a series of processes composed of compression-condensation-expansion-evaporation, and the refrigeration cycle is performed in such a way that hot air exchanges heat with a low-temperature refrigerant and then low-temperature air is supplied to a room.

The compressor compresses refrigerant gas to a high temperature and high pressure state and discharges the high temperature and high pressure refrigerant gas, and then the discharged refrigerant gas is introduced into the condenser. The condenser condenses the compressed refrigerant into a liquid phase and the liquid refrigerant releases heat to the surroundings through the condensation process. The expansion valve expands the high-temperature and high-pressure liquid refrigerant, which has been condensed in the condenser, into the low-pressure liquid refrigerant. The evaporator evaporates the refrigerant that has been expanded in the expansion valve. The evaporator performs heat exchange with an object to be cooled by using latent heat of vaporization of the refrigerant, thereby achieving the refrigeration effect, and then the evaporator returns the low-temperature and low-pressure refrigerant gas to the compressor. Through this cycle, an air temperature in an indoor space may be adjusted.

An outdoor unit of the air conditioner is a part, which is composed of the compressor and an outdoor heat exchanger, in the refrigeration cycle. The expansion valve may be provided in either the indoor unit or the outdoor unit, and an indoor heat exchanger may be provided in the indoor unit of the air conditioner.

The disclosure relates to an air conditioner configured to cool an indoor space, and the outdoor heat exchanger serves as a condenser, and the indoor heat exchanger serves as an evaporator. Hereinafter for convenience, the indoor unit including the indoor heat exchanger is referred to as an air conditioner, and the indoor heat exchanger is referred to as a heat exchanger.

Figure 2:
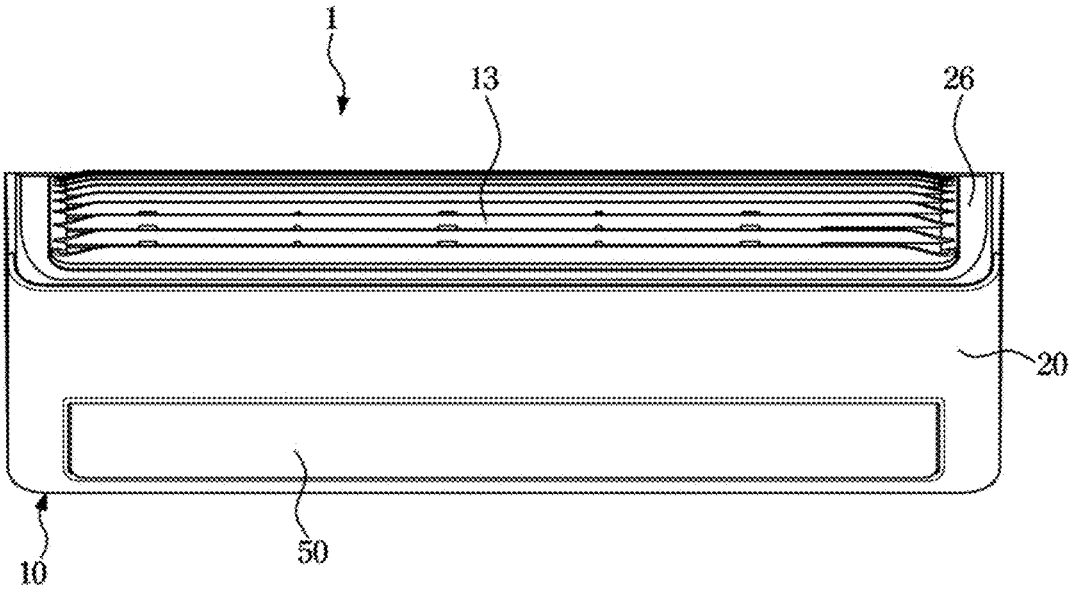
FIG. 2 is a front view of the air conditioner shown in FIG. 1.
Figure 3:
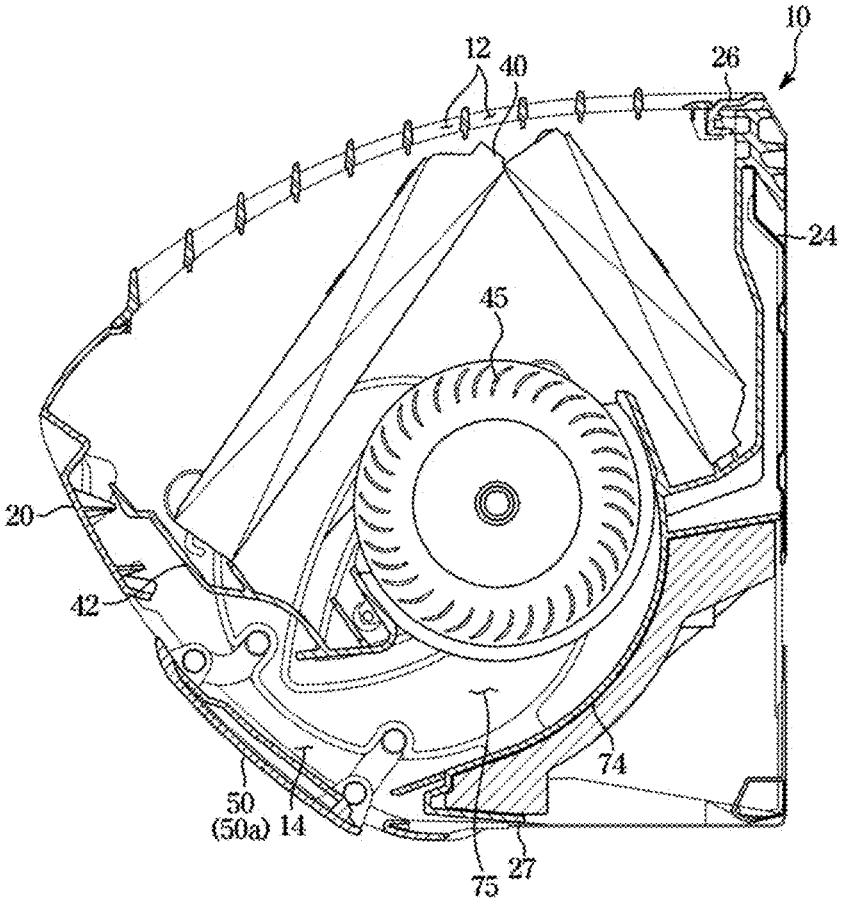
FIG. 3 is a cross-sectional view of the air conditioner shown in FIG. 1.

FIG. 1 is a perspective view of an air conditioner according to an embodiment of the disclosure. FIG. 2 is a front view of the air conditioner shown in FIG. 1. FIG. 3 is a cross-sectional view of the air conditioner shown in FIG. 1.

An air conditioner 1 shown in FIG. 1 is a wall-mounted air conditioner 1 installed on a wall, but is not limited thereto.

Referring to FIGS. 1 to 3, the air conditioner 1 may include a housing 10 including an inlet 12 and an outlet 14.

The air conditioner 1 may include a heat exchanger 40 configured to exchange heat with air introduced into an inside of the housing 10, and a blower fan 45 configured to circulate air to the inside or the outside of the housing 10.

The housing 10 may include a front panel 20 including the outlet 14, a rear panel 24 disposed behind the front panel 20, a pair of side panels 25 provided between the front panel 20 and the rear panel 24, an upper panel 26 provided with the inlet 12 and disposed on an upper side of the pair of side panels 25, a lower panel 27 disposed on a lower side of the pair of side panels 25, and a drain panel 42 provided in an inner space surrounded by the other panels 20, 24, 25, 26, and 27.

The outlet 14 and the inlet 12 may be described as provided on the front panel 20 and the upper panel 26, respectively, but are not limited thereto. In addition, each of the panels 20, 24, 25, 26, 27, and 42 may be formed integrally or may be formed separately, or at least two or more thereof may be provided integrally.

The upper panel 26 may be provided with a suction guide 13 configured to guide air to the inlet 12. A plurality of suction guides 13 may be formed in parallel along a longitudinal direction of the housing 10.

The air conditioner 1 may include a blade 50 configured to open and close the outlet 14. The blade 50 is rotatably provided in the housing 10.

The blade 50 may be moved between a closed position 50*a* for closing the outlet 14 and an open position 50*b* (Refer to FIG. 10) for opening the outlet 14 so as to guide air that is blown from the blower fan 45 and then discharged to the outlet 14.

The open position 50*b* corresponds to a position in which the blade 50 guides air discharged through the outlet 14, and further the open position 50*b* is a position in a predetermined angle range in which the blade 50 controls a direction of the discharged air.

The heat exchanger 40 may be disposed in the inside of the housing 10 and may be disposed on a path of air movement from the inlet 12 to the outlet 14. The heat exchanger 40 is configured to absorb heat from the air introduced into the inlet 12 or to transfer heat to the air. The drain panel 42 may be provided under the heat exchanger 40 to allow moisture, which is condensed in the heat exchanger 40, to be stored therein. The drain panel 42 may discharge the condensed moisture to the outside of the housing 10 by being connected to a drain hose (not shown) that is connected to the outside of the housing 10.

The blower fan 45 is disposed in the inside of the housing 10. The blower fan 45 is configured to blow air to allow air to flow from the inlet 12 to the outlet 14. The blower fan 45 may be a cross-flow fan including the same longitudinal direction as the longitudinal direction of the housing 10.

The air conditioner 1 may include a flow guide 74. The flow guide 74 is configured to guide air blown from the blower fan 45.

The flow guide 74 is provided to form an air flow path 75 through which air flows from the blower fan 45 to the outlet 14. The air flow path 75 may be connected to the outlet 14. The outlet 14 may be located at an end of the flow guide 74. The outlet 14 may be located on an extension line of the movement path of air guided by the flow guide 74.

Figure 4:
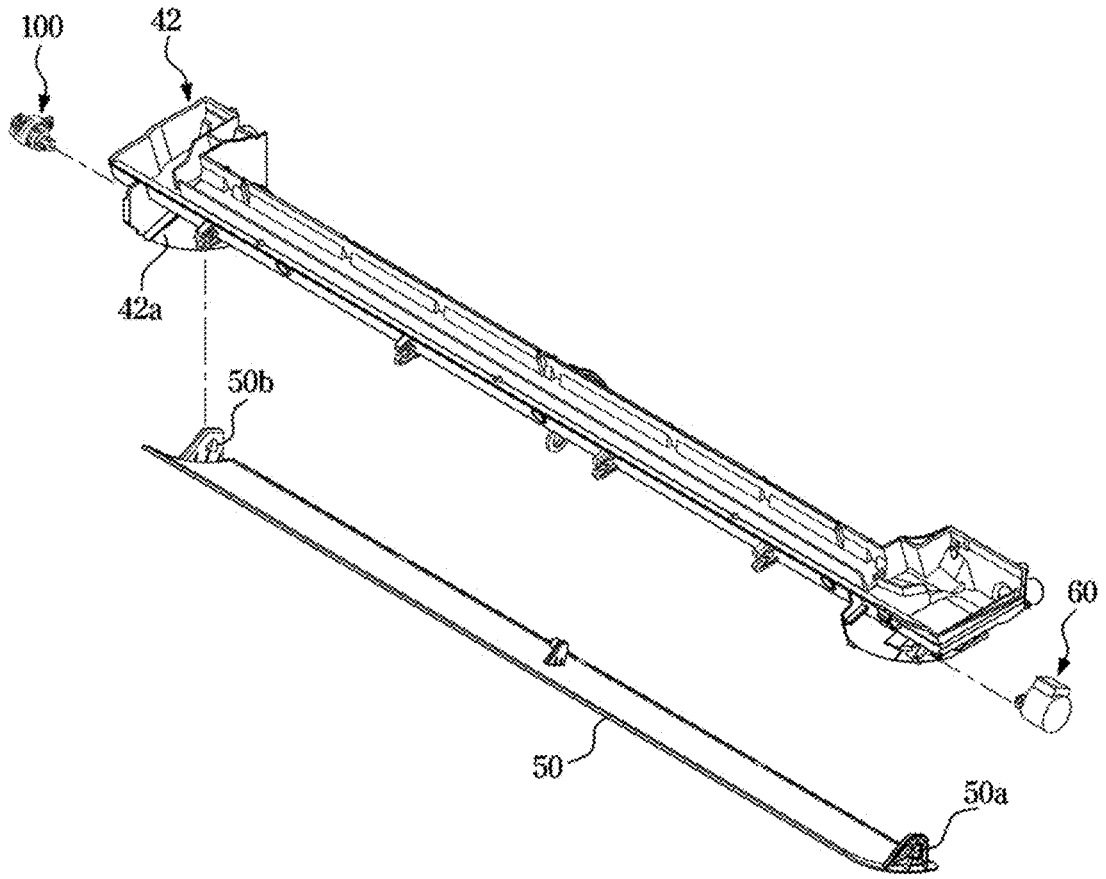
FIG. 4 is an exploded perspective view of some components of the air conditioner shown in FIG. 1.
Figure 5:
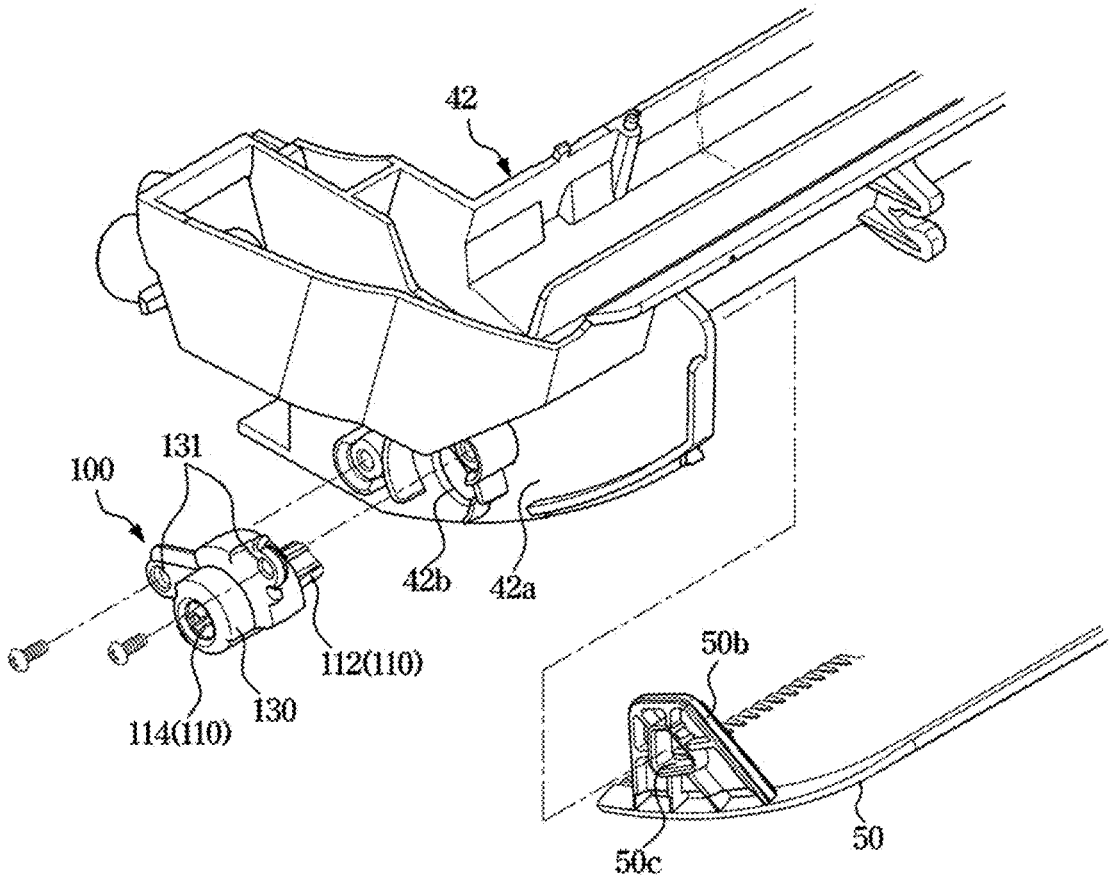
FIG. 5 is an exploded view of a blade and a blade support unit of the air conditioner shown in FIG. 1.
Figure 6:
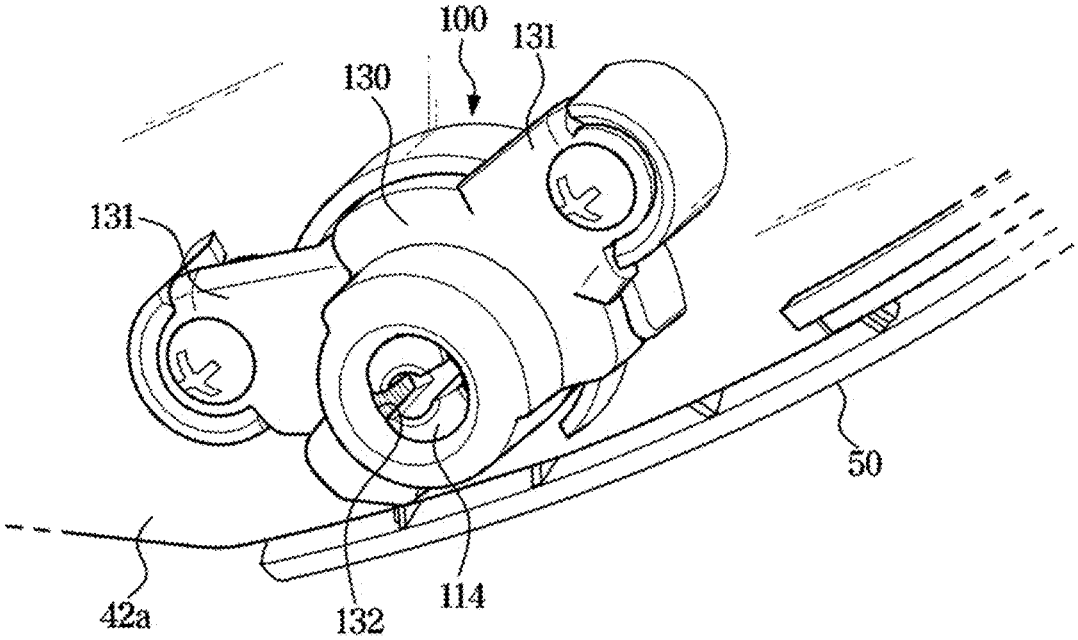
FIG. 6 is a view of the blade support unit mounted on the air conditioner shown in FIG. 1.

FIG. 4 is an exploded perspective view of some components of the air conditioner shown in FIG. 1. FIG. 5 is an exploded view of a blade and a blade support unit of the air conditioner shown in FIG. 1. FIG. 6 is a view of the blade support unit mounted on the air conditioner shown in FIG. 1.

Referring to FIGS. 4 to 6, the air conditioner may include the blade 50, a blade drive device 60, and a blade support unit 100. The blade drive device 60 may include a single drive motor configured to rotate the blade 50.

The blade drive device 60 and the blade support unit 100 may be arranged on an outer surface of the drain panel 42 and coupled to a side surface of the blade 50.

Referring to FIG. 4, the blade drive device 60 is coupled to the blade 50 from a right surface 50*a* of the blade 50 that is the right side when viewed from the front of the air conditioner 1, and the blade support unit 100 is coupled to the blade 50 from a left surface 50*b* of the blade 50 that is the left side when viewed from the front of the air conditioner 1.

However, it is not limited thereto. Alternatively, the blade drive device 60 may be coupled to the blade 50 from the left surface 50*b* of the blade 50, and the blade support unit 100 may be coupled to the blade 50 from the right surface 50*a* of the blade 50. Alternatively, the blade drive device 60 and the blade support unit 100 may not be disposed on the outer surface of the drain panel 42 but may be disposed on an inner surface of the side panel 25.

The drain panel 42 may include a blade mounting portion 42*a* provided to extend downward to cover the left surface 50*b* and the right surface 50*a* of the blade 50. The blade mounting portion 42*a* may include a pair of first through hole 42*b* provided to pass through the blade mounting portion 42*a* to allow the blade drive device 60 and the blade support unit 100, which are provided on the outer surface of the drain panel 42, to be respectively coupled to the right surface 50*a* and the left surface 50*b* of the blade 50.

By the first through hole 42*b* penetrating the blade mounting portion 42*a*, a rotating shaft of the drive motor may be coupled to the right surface 50*a* of the blade 50, and a blade holder 110 of the blade support unit 100 may be coupled to the left surface 50*b* of the blade 50.

Hereinafter because the first through hole 42*b* on a side where the blade support unit 100 is installed will be described, the first through hole 42*b* refers to a first through hole 42*b* on a side surface where the blade support unit 100 is installed.

Figure 7:
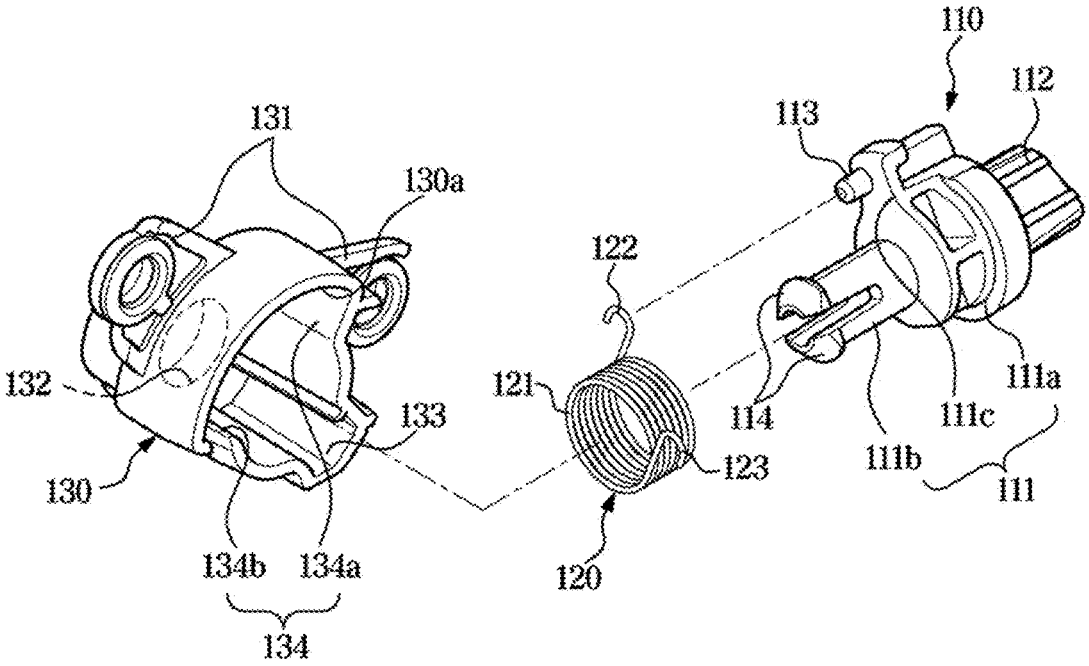

FIG. 7 is an exploded perspective view of the blade support unit shown in FIG. 6.

Figure 8:
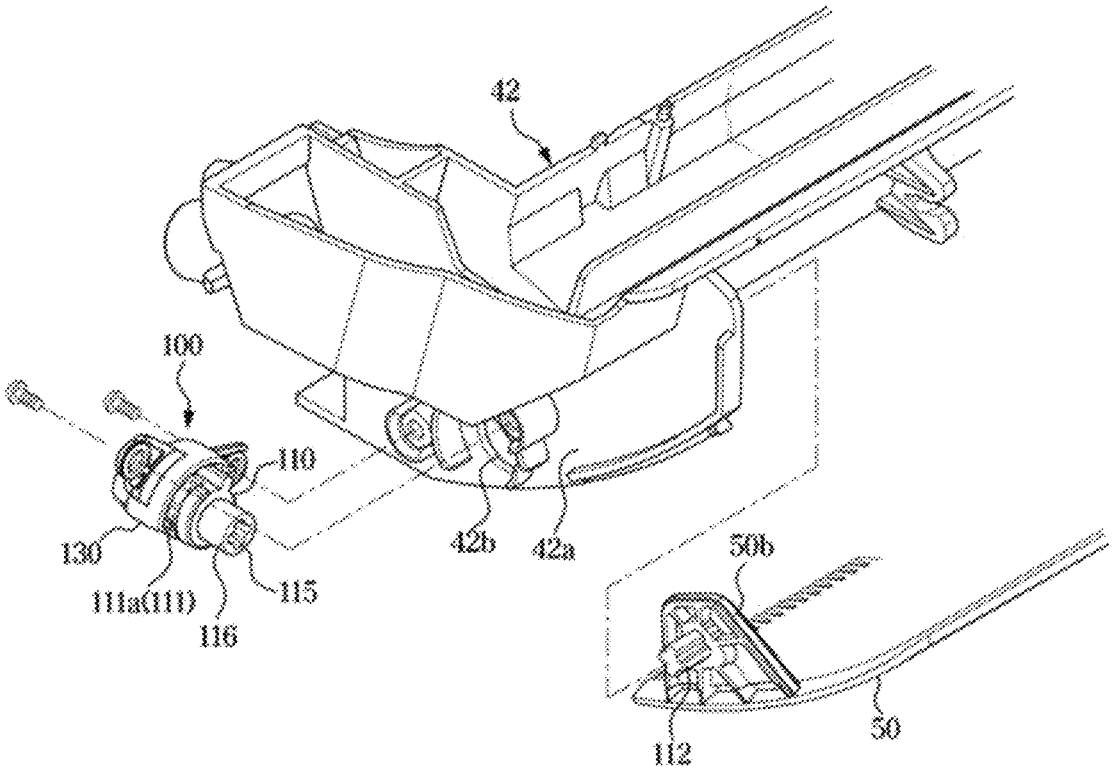
FIG. 8 is an exploded view of a blade and a blade support unit of an air conditioner according to another embodiment of the disclosure.

FIG. 8 is an exploded view of a blade and a blade support unit of an air conditioner according to another embodiment of the disclosure.

Referring to FIG. 7, the blade support unit 100 may include the blade holder 110, an elastic member 120, and a case 130.

The blade holder 110 may include a body 111, a mounting protrusion 112, and a first coupler 113. The blade holder 110 may be coupled to one end of the blade 50 in the longitudinal direction. Particularly, the blade holder 110 may be coupled to the left surface 50*b* in the longitudinal direction of the blade 50.

More particularly, the mounting protrusion 112 insertable into the left surface 50*b* of the blade 50 may be formed on one end of the body 111 of the blade holder 110, and a mounting groove 115 corresponding to the mounting protrusion 112 may be formed on the left surface 50*b* of the blade 50. As the mounting protrusion 112 of the blade holder 110 penetrates the first through hole 42*b* and is fitted into the mounting groove 115 of the blade 50, the blade holder 110 and the blade 50 may be coupled to each other, and the blade 50 and the blade holder 110 may be rotated together in the same direction. At this time, the mounting protrusion 112 may correspond to the rotating shaft of the blade. However, it is not limited thereto.

Referring to FIG. 8, as for an air conditioner 1 shown in FIG. 8, a mounting protrusion 112 may be formed on a left surface 50*b* of a blade 50, and the mounting protrusion 112 may be coupled to a blade holder 110. Particularly, a mounting body 116 may be provided on one end of a body 111 of the blade holder 110, and a mounting groove 115 corresponding to the mounting protrusion 112 may be provided in the inside of the mounting body 116. The mounting body 116 and the blade holder 110 may be provided integrally with each other. The blade 50 and the mounting protrusion 112 may be provided integrally with each other.

As the mounting protrusion 112 of the blade 50 is fitted into the mounting groove 115 of the blade holder 110, the blade holder 110 may be coupled to the blade 50, and the blade 50 and the blade holder 110 may be rotated together in the same direction. At this time, the mounting protrusion 112 may correspond to the rotating shaft of the blade. Other components of the air conditioner 1 shown in FIG. 8 may be configured in the same manner as the air conditioner 1 shown in FIG. 7.

However, it is not limited thereto. For example, the blade holder 110 and the left surface 50*b* of the blade 50 may be coupled to each other by an adhesive member or the like therebetween.

Referring again to FIG. 7, the body 111 of the blade holder 110 may include a portion having a tower shape in which two cylinders having different outer diameters are coupled to each other in such a way that a center line thereof coincides with each other. The two cylinders may be integrally formed with each other. However, it is not limited thereto.

As for the body, the mounting protrusion 112 may be provided on one end of a part of the body (hereinafter referred to as "first portion 111*a*") forming a cylinder having a diameter greater than a diameter of other cylinder between the two cylinders, and a locking protrusion 114 may be provided on one end of a part of the body (hereinafter referred to as "second portion 111*b*") forming a cylinder having a diameter less than the diameter of other cylinder between the two cylinders and configured to be rotatably coupled to the case 130. The mounting protrusion 112 and the locking protrusion 114 may be integrally formed with the body 111.

The first coupler 113 may be provided on a side surface of the body 111 of the blade holder 110. Particularly, a rotation arm 111*c* configured to be rotated in response to a rotation of the blade holder 110 may be formed on the side surface of the first portion 111*a* of the body 111, and the first coupler 113 may be formed on one surface of the rotation arm 111*c* to protrude toward the second portion 111*b*. The body 111, the rotation arm 111*c*, and the first coupler 113 of the blade holder 110 may be integrally formed with each other.

The first coupler 113 may have a space apart from the second portion 111*b*. That is, the first coupler 113 may be provided to be spaced apart so as not to be in contact with the second portion 111*b*.

The blade support unit 100 may include the elastic member 120 to apply torque to the blade holder 110.

The elastic member 120 may include a coil spring. Particularly, the elastic member 120 may include a torsion coil spring. However, it is not limited thereto and may include another member configured to apply torque to the blade holder 110.

The elastic member 120 may include a general torsion coil spring. The coil spring may include a coil 121 configured to provide an elastic force, a first extended portion 122 provided to extend from one end of the coil 121 and a second extended portion 123 provided to extend from the end of the coil 121.

The first extended portion 122 of the coil spring may be coupled to the first coupler 113. Particularly, a hook may be formed at one end of the first extended portion 122 and the first extended portion 122 may be coupled to the first coupler 113 in response to engagement of the hook to the first coupler 113. The first coupler 113 may have a cylindrical shape corresponding to the shape of the hook. However, it is not limited thereto, and the coil spring may include other means configured to couple the first extended portion 122 to the first coupler 113 rather than a hook.

The coil 121 of the coil spring may be provided on the body 111 of the blade holder 110. Particularly, the coil 121 may include a cylindrical shape including a hollow space, and an inner diameter and an outer diameter of the coil may be greater than the outer diameter of the second portion 111*b* of the body and less than an outer diameter of the first portion 111*a*. Accordingly, the coil 121 may be rotatably provided on the body 111 of the blade holder 110 by passing through the second portion 111*b*. In other words, the coil 121 may be disposed between the first portion 111*a* and the locking protrusion 114.

The second extended portion 123 of the coil spring may be coupled to the case 130 of the blade support unit 100.

The blade support unit 100 may include the case 130 provided to accommodate the blade holder 110 and the elastic member 120 therein.

The case 130 may include one or two fixers 131 configured to fix the blade support unit 100 to the outer surface of the blade mounting portion 42*a* of the drain panel 42. The case 130 may be fixed to the blade mounting portion 42*a* by a screw passing through the fixer 131 so as not to move. However, it is not limited thereto, and the case 130 may include other means configured to fix the case 130 to the blade mounting portion 42*a*.

The case 130 may include a rail 130*a* configured to accommodate the first coupler 113 therein and provided with a movement path of the first coupler 113. The rail 130*a* may be integrally formed with the case 130. The first coupler 113 may be rotated in response to the rotation of the blade holder 110 and then moved in the rail 130*a*.

An opening may be formed on one surface of the case 130, and a second through hole 132 may be formed on a side of the case 130 facing the opening and configured to allow the blade holder 110 to be coupled thereto.

The case 130 may be rotatably coupled to the blade holder 110. Particularly, the locking protrusion 114 of the blade holder 110 may be rotatably coupled to the case 130 by being inserted into the second through hole 132.

The locking protrusion 114 may be provided on one end of the second portion 111*b* of the blade holder 110 and an inner diameter of the second through hole 132 may be the same as or greater than an outer diameter of the second portion 111*b* of the blade holder 110. The inner diameter of the second through hole 132 may be less than an outer diameter of the first portion 111*a* of the blade holder 110 or less than a diameter of the largest outer periphery among the outer peripheries formed by the locking protrusion 114.

The locking protrusion 114 of the blade holder 110 may penetrate the case 130 from the inside of the case 130 to the outside of the case 130. The locking protrusion 114 of the blade holder 110 may be formed of a material such as synthetic resin having elasticity. The locking protrusion 114 may be elastically deformed upon being inserted into the second through hole 132 and thus the outer surface of the locking protrusion 114 may slide and pass through the second through hole 132. That is, the diameter of the largest outer periphery among the outer peripheries formed by the locking protrusions 114 may become temporarily equal to the inner diameter of the second through-hole 132. After the locking protrusion 114 passes through the second through hole 132, the locking protrusion 114 may be elastically restored and thus the diameter of the largest outer periphery among the outer peripheries formed by the locking protrusions 114 may become greater than the inner diameter of the second through-hole 132. Accordingly, the blade holder 110 is rotatably coupled to the case 130 without being removed from the case 130.

The case 130 may be provided with a second coupler 133 configured to be coupled to one end of the elastic member 120.

The second coupler 133 may be formed around the second through hole 132 and the second extended portion 123 of the elastic member 120 may be locked to the second coupler 133. Particularly, a hook may be formed at one end of the second extended portion 123, and the second coupler 133 may be formed in a shape of a groove. Therefore, the hook may be inserted into the groove of the second coupler 133 and fixed so as not to move. However, it is not limited thereto, and the second coupler 133 may include other means configured to fix the second extended portion 123 so as not to move.

As described above, in response to coupling the elastic member 120 and the blade holder 110 to the case 130, the case 130 may accommodate the elastic member 120 and a part of the blade holder 110 including the first coupler 113 therein. A part of the blade holder 110 that is not accommodated in the case 130 may be inserted into the first through hole 42*b* of the drain panel 42. However, it is not limited thereto, and the case 130 may accommodate the entire body 111 of the blade holder 110 except for the mounting protrusion 112.

All of the components forming the blade support unit 100 may be combined with the case 130, thereby forming an assembly that is separated from the air conditioner 1, and the blade support unit 100 may be manufactured, transported and distributed separately from the other components of the air conditioner 1. Therefore, the blade support unit 100 according to the disclosure may make it possible to manufacture the air conditioner 1 more efficiently. Further, by coupling the blade to one end of the blade holder 110 without any structural changes in other products, the blade support unit may be easily compatible with the other products that have a blade such as the air conditioner.

Figure 9:
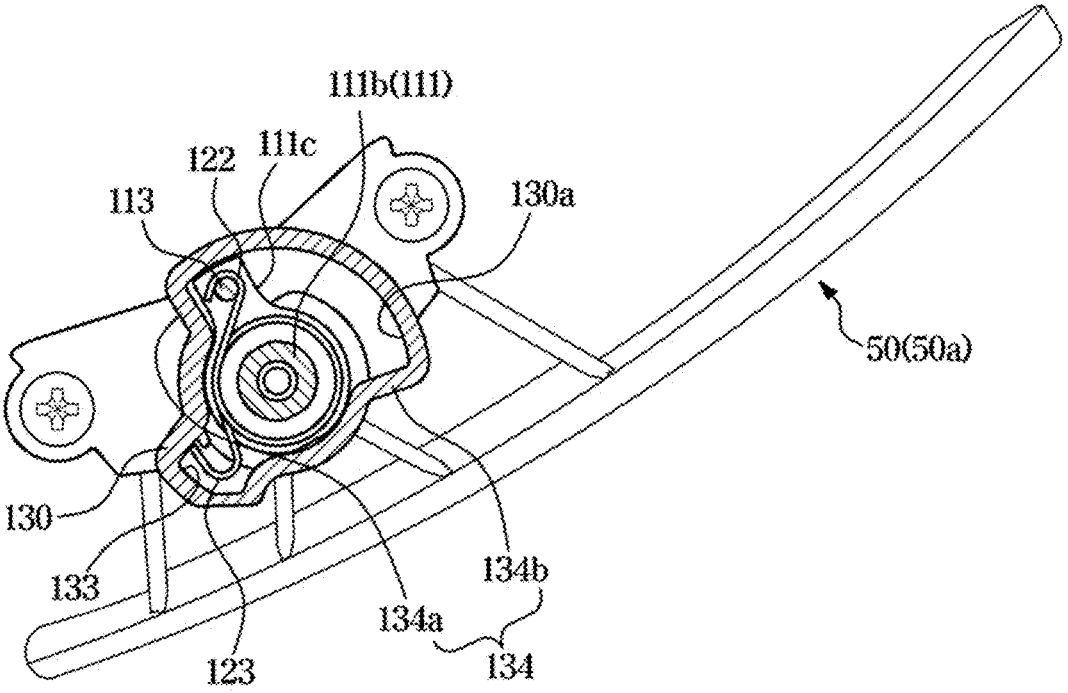
FIG. 9 is a cross-sectional view of the blade support unit in a closed state of the blade of the air conditioner shown in FIG. 1.
Figure 10:
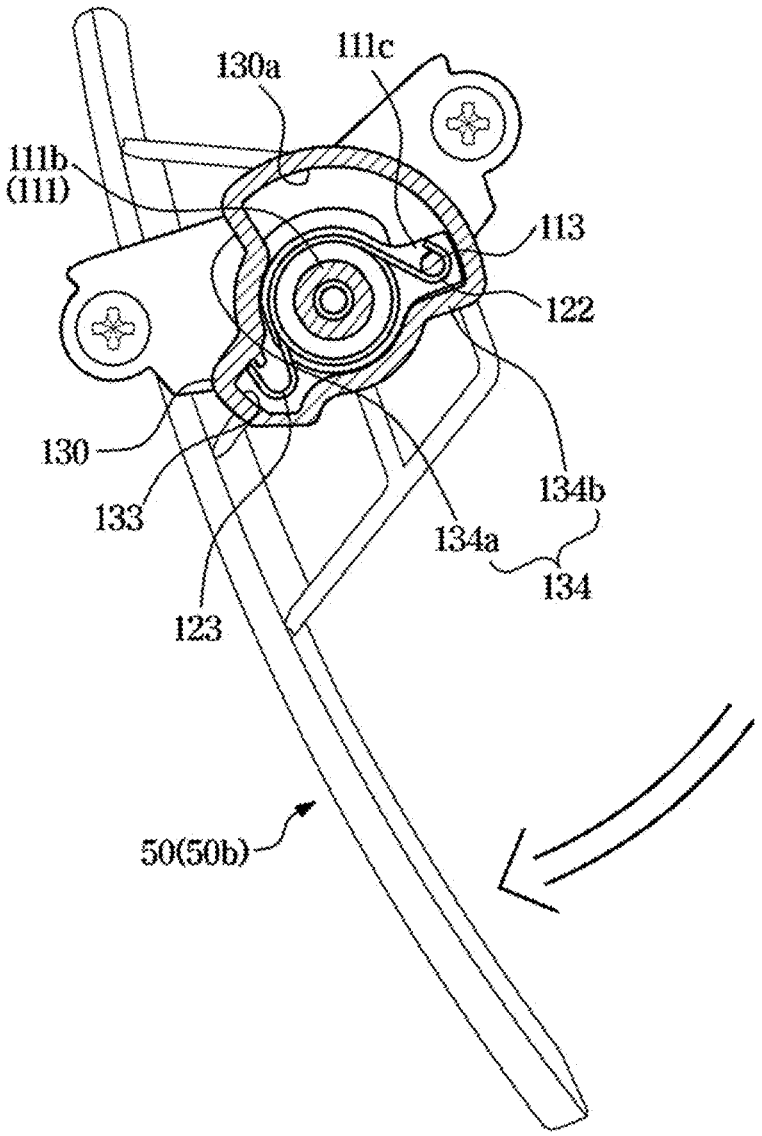
FIG. 10 is a cross-sectional view of the blade support unit in an open state of the blade of the air conditioner shown in FIG. 1.

FIG. 9 is a cross-sectional view of the blade support unit in a closed state of the blade of the air conditioner shown in FIG. 1. FIG. 10 is a cross-sectional view of the blade support unit in an open state of the blade of the air conditioner shown in FIG. 1.

Referring to FIGS. 9 and 10, the elastic member 120 may be configured apply torque to the first coupler 113 of the blade holder 110. The torque applied to the first coupler 113 may be delivered to the blade 50 through the blade holder 110.

The elastic member 120 may apply torque in a direction opposite to torque that is applied to the blade 50 to open the outlet 14 by the blade drive device 60 and the elastic member 120 may apply torque in a direction the same as torque that is applied to the blade 50 to close the outlet 14 by the blade drive device 60.

Further, although the blade 50 is placed in the closed position 50*a* closing the outlet 14, the elastic member 120 may apply torque in a direction the same as torque that is applied to the blade 50 to close the outlet 14 by the blade drive device 60. In other words, the elastic member 120 may be configured to continuously apply torque in the same direction regardless of the position of the blade 50.

Particularly, the elastic member 120 may be a torsion coil spring, and as for the torsion coil spring, deformation may be increased from a deformed state (hereinafter referred to as "first deformed state") in the closed position 50*a* of the blade 50 to a deformed state (hereinafter referred to as "second deformed state") in the open position 50*b* of the blade 50. In the first deformed state, the torsion coil spring may apply torque in a direction opposite to torque caused by the blade's own weight. Further, in the second deformed state, the torsion coil spring may apply the torque in the same direction as the first deformed state.

An angle between the first extended portion 122 and the second extended portion 123 in a state in which no external force is applied to the torsion coil spring (hereinafter referred to as "free length state") may be referred to as an angle of a free length. The torsion coil spring 120 shown in FIG. 7 is a torsion coil spring in a free length state.

The first deformed state corresponds to a state in which the first extended portion 122 is deformed in a direction, in which the coil 121 is more wound than the free length state, after the second extended portion 123 is fixed by the second coupler 133 so not to move. In other words, in the state in which the second extended portion 123 is fixed, the first extended portion 122 is deformed in the direction, in which the blade 50 is rotated, to open the outlet 14. An angle between the first extended portion 122 and the second extended portion 123 in the first deformed state may be different from the angle of the free length.

A difference between an angle, which is between the first extended portion 122 and the second extended portion 123 in the second deformed state, and the angle of the free length may be greater than a difference between an angle, which is between the first extended portion 122 and the second extended portion 123 in the first deformed state, and the angle of the free length. The second deformed state is a state in which the first extended portion 122 is deformed in a direction in which the coil 121 is wound more than in the first deformed state. That is, in order to open the outlet 14, the first extended portion 122 is further deformed in the direction in which the blade 50 is rotated. In other words, as the torsion coil spring moves from the first deformed state to the second deformed state, the direction of the torque applied to the blade holder 110 may be constant and the size of the torque may increase.

A difference between the angle formed by the first extended portion 122 and the second extended portion 123 in the first deformed state and the angle formed by the first extended portion 122 and the second extended portion 123 in the second deformed state may correspond to an angle at which the blade 50 is rotated.

Because the air conditioner 10 provided with the blade support unit 100 rotates the blade 50 by using a single blade drive device 60, it is possible to reduce material cost and to reduce the noise, which is caused by the blade drive device, in comparison with a case of using two blade drive devices. Further, in comparison with a case in which a side of the blade, on which the drive device is not provided, is pin-supported against the housing 10, it is possible to reduce the vibration and noise and it is possible to prevent the blade 50, which is placed on the side on which the drive device is not provided, from bending caused by the blade's own weight or fatigue deformation caused by repeated rotation of the blade 50.

Referring to FIGS. 9 and 10, the case 130 may include a stopper 134 configured to limit a rotation range of the blade holder 110 rotated by the elastic member 120 or the blade drive device 60.

The stopper 134 may be provided on the rail 130*a* of the case. Particularly, the stopper 134 may be provided at opposite ends of the rail 130*a*.

The stopper 134 may include a first stopper 134*a* configured to stop the blade holder 110 that is rotated in the direction[[,]] in which the blade 50 is rotated to close the outlet 14, and a second stopper 134*b* configured to stop the blade holder 110 that is rotated in the direction, in which the blade 50 is rotated to open the outlet 14.

The first stopper 134*a* and the second stopper 134*b* may block the front and rear of the path in which the first coupler 113 of the blade holder 50 moves, thereby limiting the rotation range of the first coupler 113. Particularly, the first stopper 134*a* and the second stopper 134*b* may prevent the movement of the rotation arm 111*c*, thereby stopping the rotation of the first coupler 113 and the body 111 of the blade holder 110 connected to the rotation arm 111*c*.

The first stopper 134*a* may be provided at one end of the rail 130*a*, and particularly, at a position in which the rotation arm 111*c* is placed on the rail 130*a* in the first deformed state of the torsion coil spring. Alternatively, the first stopper 134*a* may be provided at a position for allowing a length of the rail 130*a* to be greater than the case in which the first stopper 134*a* is provided at the position in which the rotation arm 111*c* is placed on the rail 130*a* in the first deformed state of the torsion coil spring.

The first stopper 134*a* may prevent that the torsion spring is restored from the first deformed state to the free length state, and thus the first stopper 134*a* may maintain the first deformed state of the torsion spring until the blade support unit 110 is mounted to the housing 10. In addition, the first stopper 134*a* may prevent the blade holder 110 from rotating beyond an allowable rotation range.

The second stopper 134*b* may be provided at the other end of the rail 130*a*, and particularly, at a position in which the rotation arm 111*c* is placed on the rail 130*a* upon the maximum rotation of the blade 50. Alternatively, the second stopper 134*b* may be provided at a position for allowing a length of the rail 130*a* to be less than the case in which the second stopper 134*b* is provided at the position in which the rotation arm 111*c* is placed on the rail 130*a* upon the maximum rotation of the blade 50.

The second stopper 134*b* may prevent the blade holder 110 from rotating beyond the maximum rotation range of the blade 50, and thus the second stopper 134*b* may prevent the torsion member 120 from plastic deformation that exceeds the elastic limit by the excessive rotation of the blade holder 110.

Figure 11:
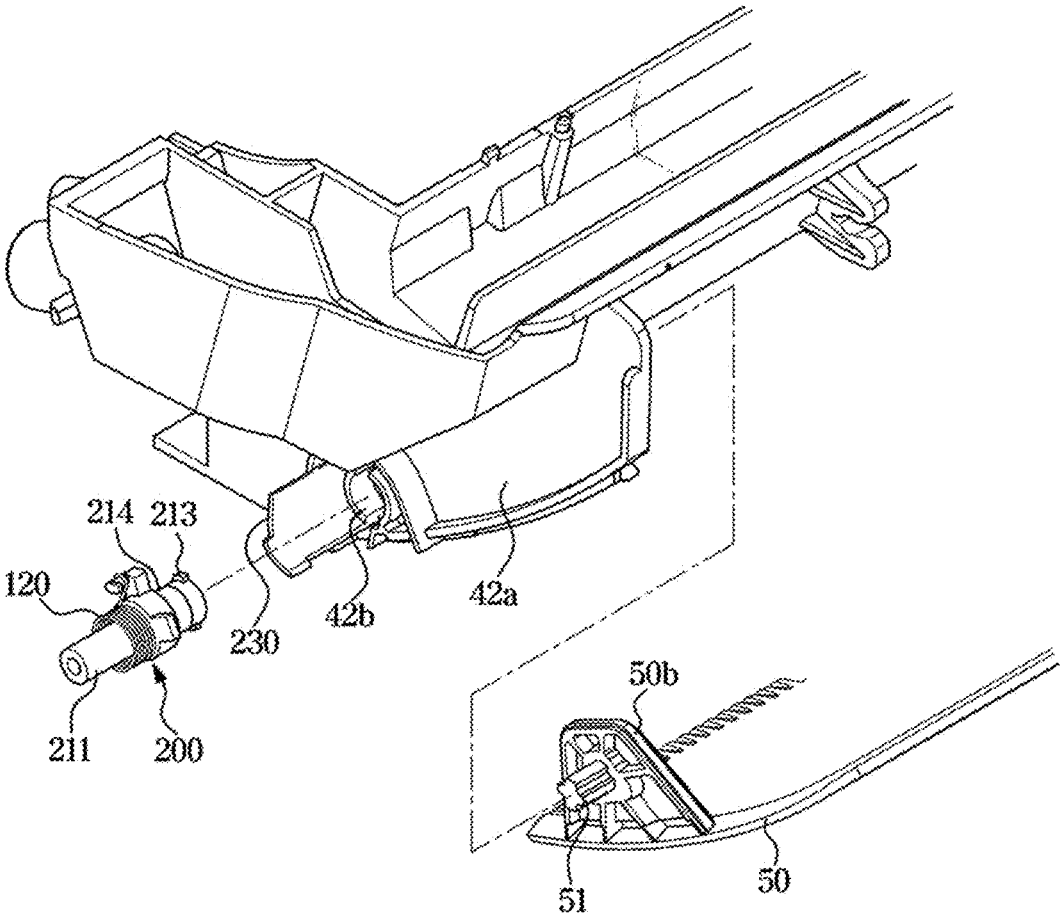
FIG. 11 is an exploded view of a blade and a blade support unit of an air conditioner according to another embodiment of the disclosure.
Figure 12:
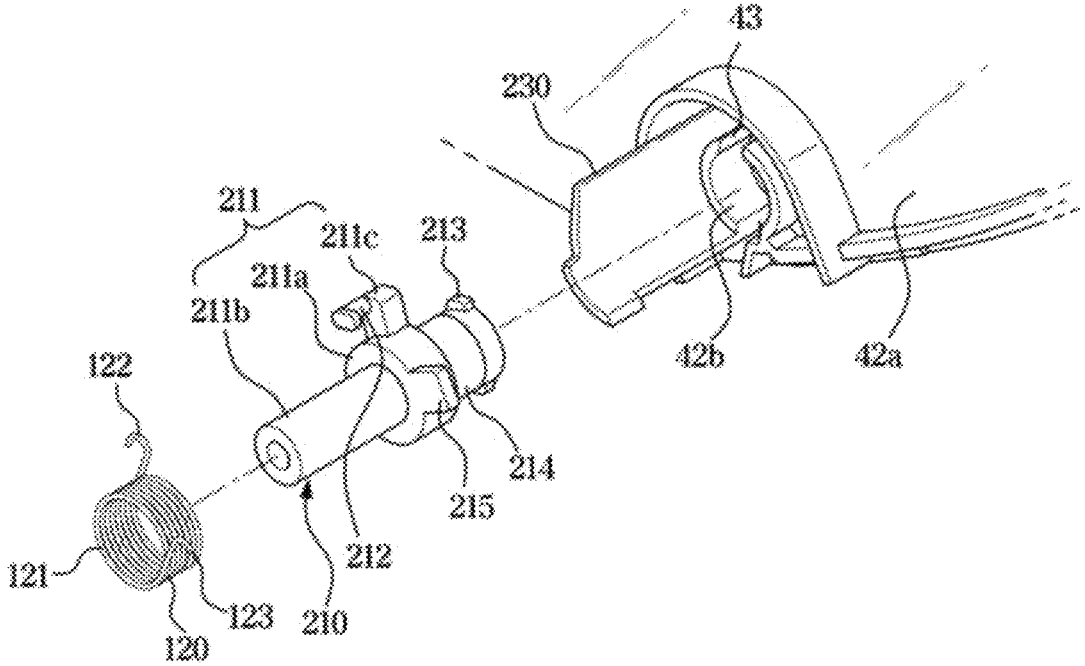
FIG. 12 is an exploded-perspective view of the blade support unit of the air conditioner shown in FIG. 11.
Figure 13:
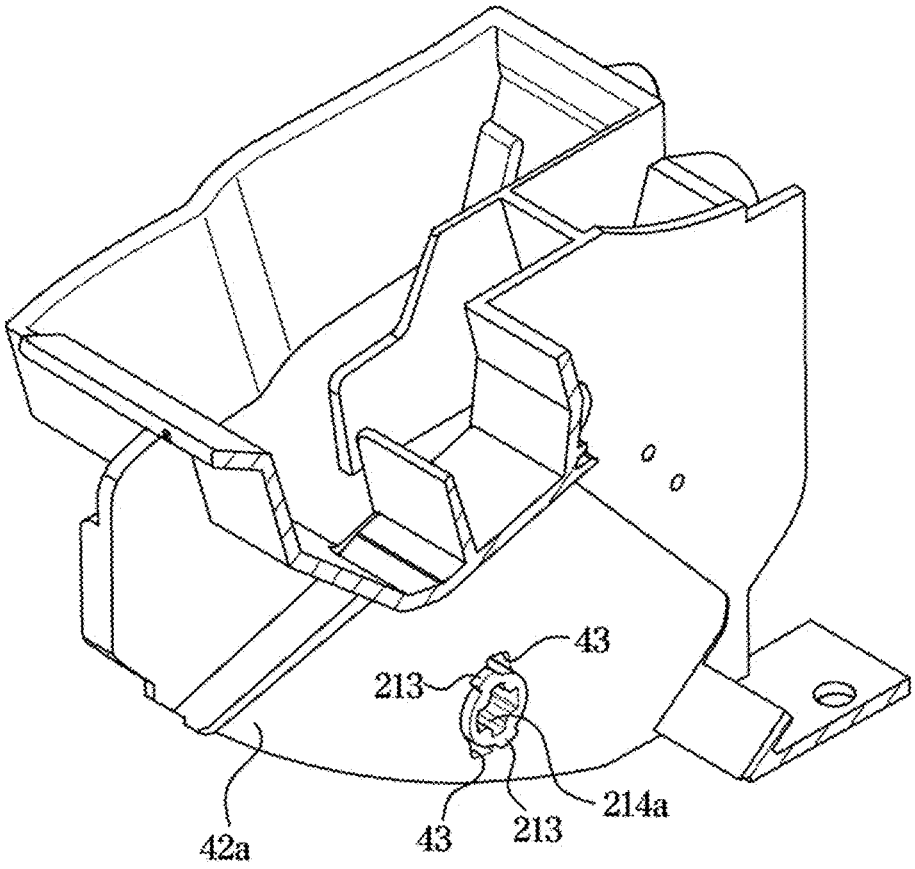
FIG. 13 is a view illustrating a state in which the blade support unit shown in FIG. 12 is mounted on the air conditioner shown in FIG. 11.
Figure 16:
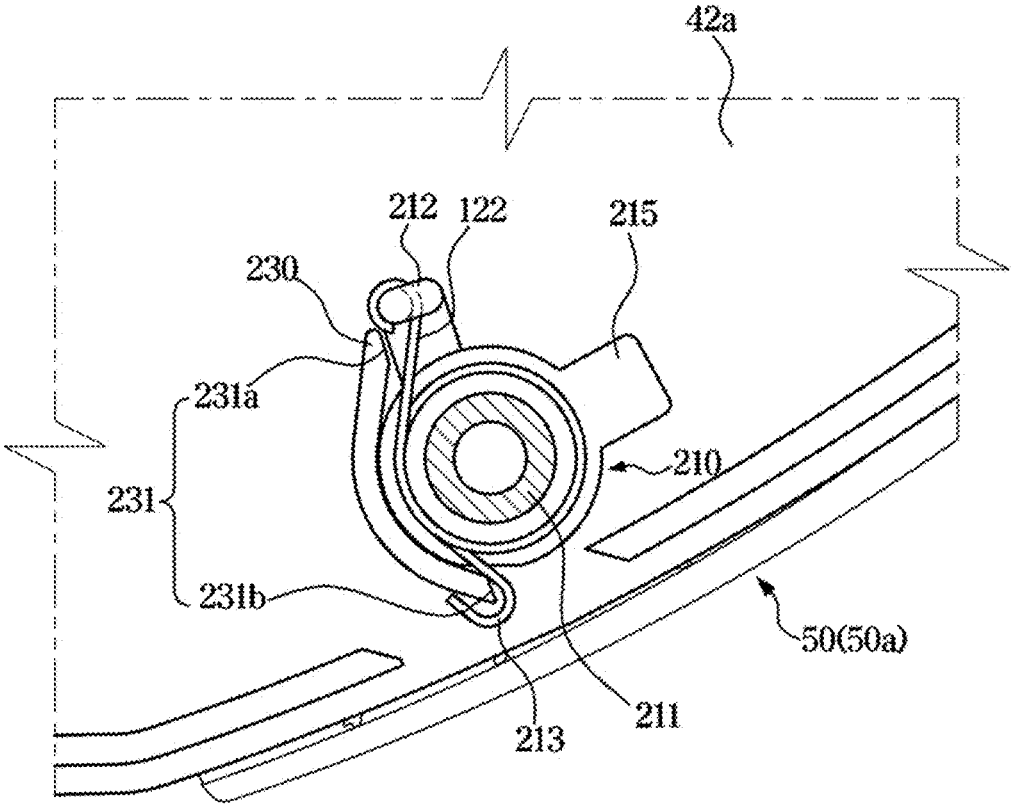
FIG. 16 is a view of the blade support unit in a closed state of the blade of the air conditioner shown in FIG. 11.

FIG. 11 is an exploded view of a blade and a blade support unit of an air conditioner according to another embodiment of the disclosure. FIG. 12 is an exploded perspective view of the blade support unit of the air conditioner shown in FIG. 11. FIG. 13 is a view illustrating a state in which the blade support unit shown in FIG. 12 is mounted on the air conditioner shown in FIG. 11. FIG. 16 is a view of the blade support unit in a closed state of the blade of the air conditioner shown in FIG. 11;

Hereinafter descriptions of parts the same as the above description will be omitted.

Referring to FIGS. 11 to 13 and 16, a blade support unit 200 may include a blade holder 210, an elastic member 120, and a second coupler 230. The case 130 may be omitted.

The elastic member 120 may include a conventional torsion coil spring, and a first extended portion 122 of the torsion coil spring may be coupled to a first coupler 212 of the blade holder 210, and a second extended portion 123 may be provided on a second coupler 230 provided in the housing 10.

Particularly, the second coupler 230 may be provided to protrude from an outer surface of the blade mounting portion 42*a* of the drain panel 42 and may be provided to surround a part of the outer periphery of the first through hole 42*b*. A hook formed at one end of the second extended portion 123 may be hooked to the second coupler 230 to fix the second extended portion 123 to the second coupler 230 so as not to move.

The blade holder 210 may include a cylindrical fastening plate body 214 provided at one end of the body 211 of the blade holder 210, and a pair of fastening plates 213 provided at a side surface of one end of the fastening plate body 214.

The fastening plate body 214 may be integrally formed with the body 211 of the blade holder 210. A mounting groove 115 configured to be coupled to the blade may be formed on one end surface of the fastening plate body 214.

The mounting protrusion 112 may be formed on the left surface 50*b* of the blade 50, and the mounting protrusion 112 may be coupled to the fastening plate body 214 by being fitted into the mounting groove 115. Accordingly, the blade 50 and the blade holder 210 may be connected to each other by the fastening plate body 214, thereby being rotated together.

However, it is not limited thereto, and in the similar manner as the air conditioner 1 shown in FIG. 5, the mounting groove 115 may be formed on the left surface 50*b* of the blade 50 and the mounting protrusion 112 may be formed on one end surface of the fastening plate body 214. Accordingly, the mounting protrusion 112 may be coupled to the mounting groove 115, and the blade 50 and the blade holder 210 may be coupled to each other.

Figure 14:
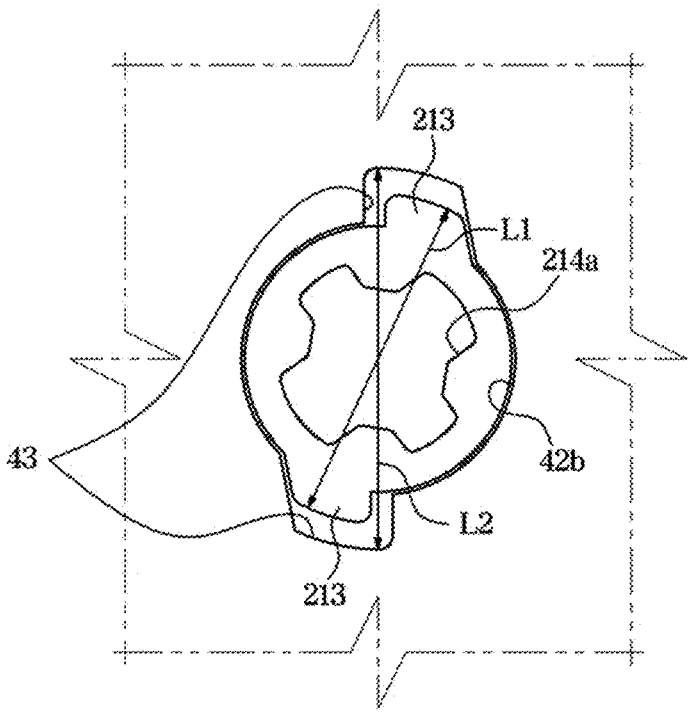
FIG. 14 is a view illustrating a state in which a fastening plate shown in FIG. 13 is inserted into a fastening groove.
Figure 15:
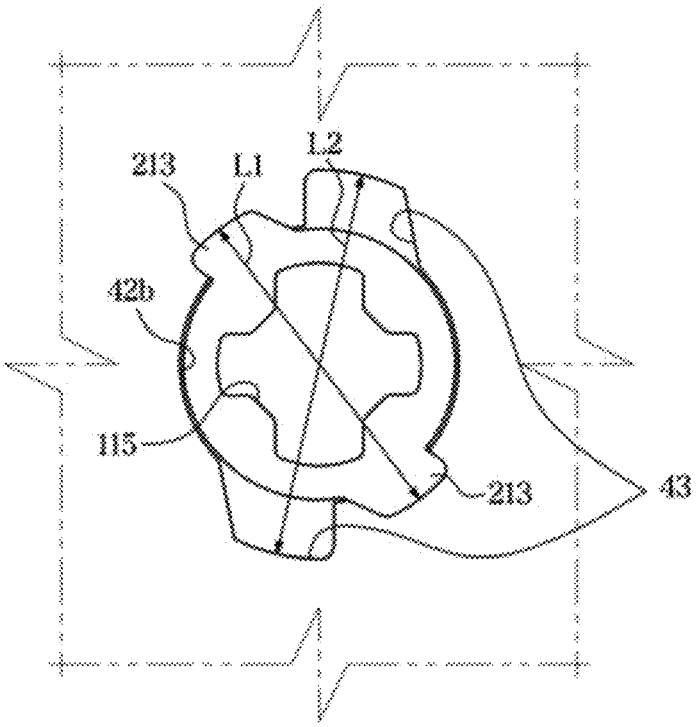
FIG. 15 is a view illustrating a state in which the fastening plate shown in FIG. 13 is rotated after being inserted into the fastening groove.

FIG. 14 is a view illustrating a state in which a fastening plate shown in FIG. 13 is inserted into a fastening groove. FIG. 15 is a view illustrating a state in which the fastening plate shown in FIG. 13 is rotated after being inserted into the fastening groove.

Referring to FIGS. 14 and 15, the pair of fastening plates 213 may be rotatably provided on a side surface of one end of the fastening plate body 214. The pair of fastening plates 213 may be disposed on a straight line extending a diameter of the fastening plate body 214 and provided to face each other.

A length L1 connecting an end of one fastening plate 213 to an end of the other fastening plate 213 is greater than a diameter of a first portion 211*a*, a diameter of the fastening plate body 214, and an inner diameter of the first through hole 42*b*.

A pair of fastening grooves 43 having a shape corresponding to the fastening plate 213 may be formed around the first through hole 42*b* formed in the blade mounting portion 42*a*. The fastening groove 43 may penetrate the blade mounting portion 42*a* and may be connected to the first through hole 42*b*. Therefore, a length L2 connecting an end of one fastening groove 43 to an end of the other fastening groove 43 is greater than or equal to the length L1 connecting the end of the pair of fastening plates 213.

The pair of fastening plates 213 may be disposed on the fastening plate body 214 so as to pass through the fastening groove 43.

The blade holder 210 may be coupled to the blade mounting portion 42*a* to allow the fastening plate 213 to be inserted into the fastening groove 43. The blade holder 210 may be inserted through the first through hole 42*b* from an outer surface side of the blade mounting portion 42*a* to an inner surface side of the blade mounting portion 42*a*, and after the blade holder 210 is inserted, the fastening plate 213 may be disposed on the inner surface of the blade mounting portion 42*a*.

The fastening plate 213 passing through the first through hole 42*b* may be rotated to prevent the blade holder 210 from being removed from the blade mounting portion 42*a*.

Particularly, the fastening plate 213 corresponding to the shape of the fastening groove 43 may pass through the fastening groove 43 while being disposed in a position facing the fastening groove 43. Sequentially, the fastening plate 213 that passed through the fastening groove 43 may be rotated and then disposed on a position that does not face the fastening groove 43.

Because the length L1 between the ends of the fastening plate 213 is greater than the diameter of the first through hole 42*b*, the blade holder 210 may not be removed from the first through hole 42*b* even when the blade holder 210 is pulled toward the outer surface of the blade mounting portion 42*a*. Further, even when the blade holder 210 is pulled toward the inner surface of the blade mounting portion 42*a*, the blade holder 210 may not be removed from the first through hole 42*b* by a rotation arm 211*c*.

However, it is not limited thereto, and a washer member may be provided between the rotation arm 211*c* and the first through hole 42*b* or between the fastening plate 213 and the first through hole 42*b*. Alternatively, in order to prevent the blade holder 210 from moving left and right in the inside of the first through hole 42*b*, a protrusion having a diameter greater than the diameter of the first through hole 42*b* may be separately formed between the rotation arm 211*c* and the first through hole 42*b*.

As for the blade support unit 200 including the fastening plate 213, the blade support unit 210 may be simply mounted to the air conditioner 1 without a separate screw or fastening member, thereby increasing production efficiency and facilitating replacement and repair thereof.

Figure 17:
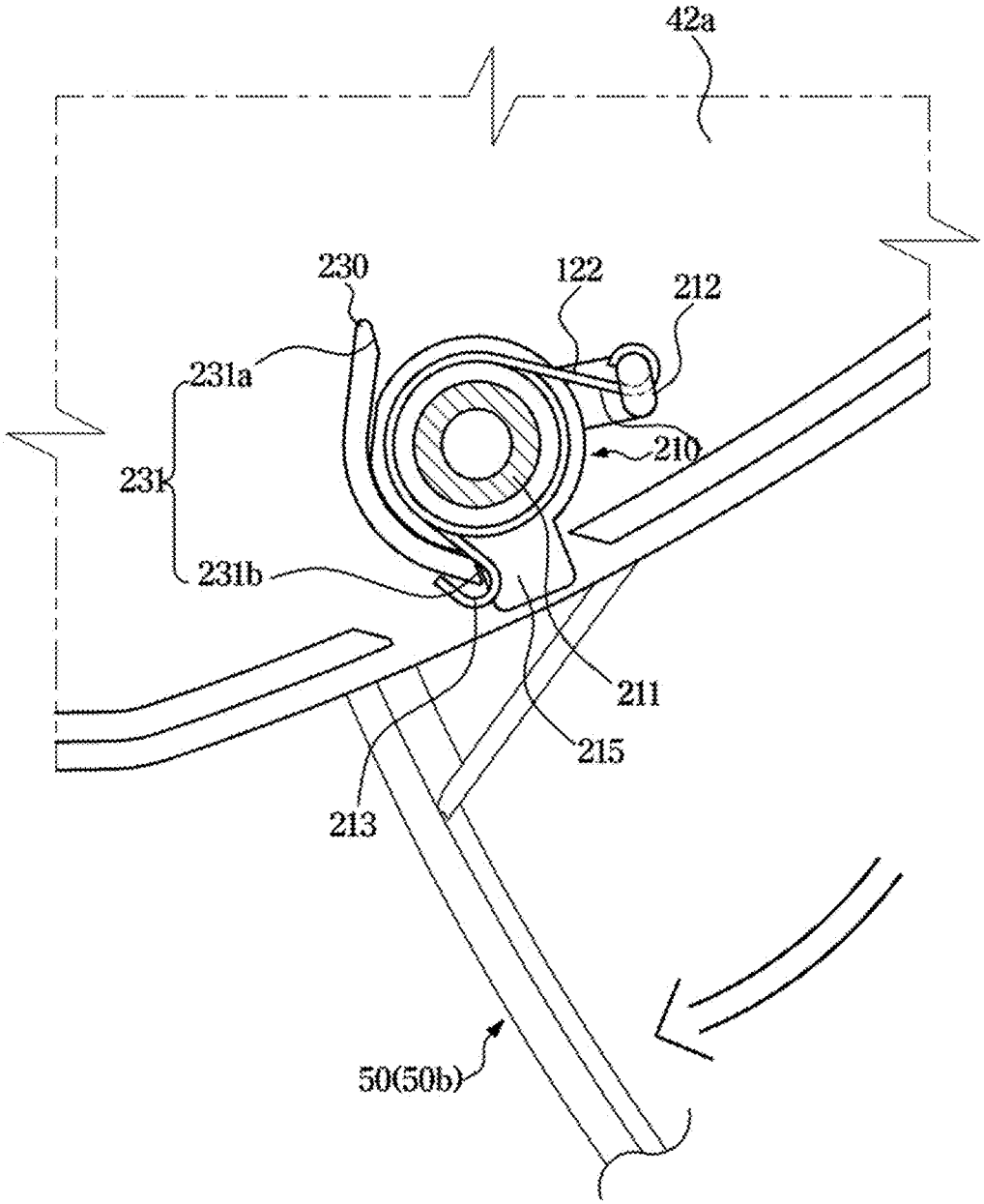
FIG. 17 is a view of the blade support unit in an open state of the blade of the air conditioner shown in FIG. 11.

FIG. 16 is a view of the blade support unit in a closed state of the blade of the air conditioner shown in FIG. 11. FIG. 17 is a view of the blade support unit in an open state of the blade of the air conditioner shown in FIG. 11.

Referring to FIGS. 16 and 17, the blade support unit 200 may include a stopper 231 provided on a movement path of the blade holder 210 so as to limit a rotation range of the blade holder 210. The stopper 231 may be provided in the housing 10. Particularly, the stopper 231 may be provided on the outer surface of the blade mounting portion 42*a* to stop the rotation of the blade holder 210.

More particularly, the stopper 231 may be provided on the second coupler 230 and may be integrally formed at opposite ends of the second coupler 230. The second coupler 230 may be provided on the movement path of the blade holder 210. Accordingly, one end of the second coupler 230, which is configured to come in contact with the blade holder 210 in response to the rotation of the blade holder 210 in the direction in which the blade 50 closes the outlet 40, may be referred to as a first stopper 231*a*. The other end of the second coupler 230, which is configured to come in contact with the blade holder 210 in response to the rotation of the blade holder 210 in the direction in which the blade 50 opens the outlet 40, may be referred to as a second stopper 231*b*. A hook of the second extended portion 123 may be hooked to the other end of the second coupler 230 corresponding to the second stopper 231*b* and then fixed.

The blade holder 210 may include a stop protrusion 215 provided on a side surface of the body 211 and configured to be rotated with the blade holder 210. The stop protrusion 215 may be provided on the outer surface of the blade mounting portion 42*a*. Particularly, the stop protrusion 215 may be provided on a side surface of one end of the first portion 211*a* of the body 211 and may be formed integrally with the body 211.

The first stopper 231*a* may stop the rotation of the blade holder 210 by stopping the movement of the rotation arm 211*c* in response to the rotation of the blade 50 in the direction in which the blade 50 closes the outlet 14.

The second stopper 231*b* may stop the rotation of the blade holder 210 by stopping the movement of the stop protrusion 215 in response to the rotation of the blade 50 in the direction in which the blade 50 opens the outlet 14.

The stopper 231 may prevent the blade holder 210 from rotating beyond the maximum rotation range of the blade 50, and thus the stopper 231 may prevent the elastic member 120 from plastic deformation that exceeds the elastic limit by the excessive rotation of the blade holder 210.

As is apparent from the above description, in comparison with a case of using two blade drive devices, the air conditioner may minimize the noise or vibration and reduce material cost even when using a single blade drive device.

The air conditioner may prevent the blade from bending caused by the blade's own weight or prevent fatigue deformation of the blade caused by repeated rotation of the blade.

The air conditioner may include the blade support unit that is manufactured, transported and distributed separately from other components of the air conditioner, thereby increasing the manufacturing efficiency.

Although a few embodiments of the disclosure have been shown and described, it would be appreciated by those skilled in the art that changes may be made in these embodiments without departing from the principles and spirit of the disclosure, the scope of which is defined in the claims and their equivalents,

What is claimed is:

1. An air conditioner co p sing:

a housing having an inlet and an outlet;

a blade which is rotatable to open and close the outlet;

a blade drive device coupled to one end of the blade in a longitudinal direction of the blade and configured to rotate the blade; and a blade support configured to rotatably support the other end of the blade in the longitudinal direction of the blade, the blade support comprising:

a coil spring having a coil and configured to apply torque to the blade;

a blade holder coupled to the other end of the blade, comprising a coupler configured to extend into the coil of the coil spring; and a case coupled to the housing and configured to accommodate the coupler.

2. The air conditioner of claim 1, wherein the blade holder is rotatably coupled to the case.

3. The air conditioner of claim 2, wherein the coupler is a first coupler, and the case includes a second coupler coupled to the coil spring.

4. The air conditioner of claim 3, wherein the coil spring is between the case and the blade holder.

5. The air conditioner of claim 3, wherein the coil spring comprises a first extended portion provided to extend from one side of the coil and a second extended portion provided to extend from the other side of the coil, and the first extended portion is fixed to the first coupler and the second extended portion is fixed to the second coupler.

6. The air conditioner of claim 2, wherein the coupler is rotated based on a rotation of the blade holder, and the case comprises a rail configured to guide a movement of the coupler.

7. The air conditioner of claim 6, wherein the case comprises a stopper disposed at opposite ends of the rail and configured to limit a movement range of the coupler.

8. The air conditioner of claim 1, wherein the blade holder transmits the torque which is applied to the blade holder by the coil spring, to the blade, and the coil spring applies the torque to the blade holder.

9. The air conditioner of claim 8, wherein the coil spring is configured to apply the torque in a direction opposite to a torque that is applied by the blade drive device to the blade to open the outlet.

10. The air conditioner of claim 1, wherein the case accommodates the blade holder and the coil spring, and the case comprises a fixer configured to fix the case to the housing.

11. An air conditioner comprising:

a housing having an inlet and an outlet;

a blade which is rotatable to open and close the outlet;

a blade drive device coupled to one end of the blade in a longitudinal direction of the blade and configured to rotate the blade; and a blade support configured to rotatably support the other end of the blade in the longitudinal direction of the blade, the blade support comprising:

an elastic member configured to apply torque to the blade;

a blade holder coupled to the other end of the blade so as to be rotated according to a rotation of the blade, the blade holder comprising a coupler configured to be coupled to one end of the elastic member; and a case rotatably coupled to the blade holder and configured to accommodate the coupler and the elastic member, the case being coupled to the housing, the case comprising:

a stopper on a movement path of the coupler to limit a rotation range of the blade holder.

12. An air conditioner comprising:

a housing having an opening configured to avow aft to be discharged;

a blade which is rotatable to open and close the opening of the housing;

a blade drive device coupled to one end of the blade and configured to rotate the blade; and a blade support configured to rotatably support the other end of the blade, the blade support comprising:

a blade holder coupled to the blade and configured to be rotated according to a rotation of the blade;

an elastic member configured to apply torque to the blade holder; and a stopper on a movement path of the blade holder to limit a rotation range of the blade holder.

13. The air conditioner of claim 12, wherein the elastic member comprises a torsion spring member comprising a coil configured to provide an elastic force, a first extended portion extending from one side of the coil and a second extended portion extending from an other side of the coil.

14. The air conditioner of claim 13, wherein the blade holder comprises a rotation arm extending from a side surface of the blade holder and configured to be rotated with the blade holder, and a coupler provided on one end of the rotation arm, the coupler being coupled to one end of the elastic member, the coil is configured to surround the blade holder, and the first extended portion is coupled to the coupler.

15. The air conditioner of claim 14, further comprising:

a case rotatably coupled to the blade holder and configured to cover the elastic member and the blade holder, a movement path of the blade holder being provided in the case, wherein the case is fixed to the housing so as not to move.

16. The air conditioner of claim 15, wherein the coupler is a first coupler, the case comprises a second coupler configured to be coupled to an other end of the elastic member, and the second extended portion is coupled to the second coupler.

17. The air conditioner of claim 15, wherein the stopper is in the case.

18. The air conditioner of claim 14, wherein the coupler is a first coupler, a second coupler to which the other end of the elastic member is coupled, is in the housing, and the second extended portion is coupled to the second coupler.

19. The air conditioner of claim 18, wherein the blade holder comprises a stop protrusion configured to be rotated with the blade holder, the stopper comprises a pair of stoppers integrally formed with the second coupler, one of the pair of stoppers is provided on a movement path of the stop protrusion to stop the movement of the stop protrusion, and the other of the pair of stoppers is provided on a movement path of the rotation arm to stop a movement of the rotation arm.

20. The air conditioner of claim 18, wherein the housing comprises a fastening groove configured to be coupled to the blade holder, the blade holder comprises a fastening plate rotatably provided on the blade holder and configured to penetrate the fastening groove, and the blade holder is configured to be inserted into the housing so that the fastening plate penetrates the fastening groove, and the blade holder is coupled to the housing to prevent the fastening plate from being removed from the fastening groove due to a rotation of the fastening plate.

* * * * *